US009316022B2

(12) United States Patent
Tyner et al.

(10) Patent No.: US 9,316,022 B2
(45) Date of Patent: Apr. 19, 2016

(54) LOCK ASSEMBLY HAVING LOCK POSITION SENSOR

(71) Applicant: Stanley Security Solutions, Inc., Indianapolis, IN (US)

(72) Inventors: Anthony Tyner, Indianapolis, IN (US); Chad A. Hickman, Rensselaer, IN (US)

(73) Assignee: Stanley Security Solutions, Inc., Indianapolis, IN (US)

( * ) Notice: Subject to any disclaimer, the term of this patent is extended or adjusted under 35 U.S.C. 154(b) by 262 days.

(21) Appl. No.: 14/106,994

(22) Filed: Dec. 16, 2013

(65) Prior Publication Data

US 2014/0165673 A1 Jun. 19, 2014

Related U.S. Application Data

(60) Provisional application No. 61/738,990, filed on Dec. 18, 2012.

(51) Int. Cl.
*E05B 17/00* (2006.01)

(52) U.S. Cl.
CPC ..... *E05B 17/00* (2013.01); *Y10T 70/5372* (2015.04)

(58) Field of Classification Search
CPC ..... E05B 47/0012; E05B 47/0692; E05B 15/0033; E05B 63/16; E05B 2047/0026; E05B 41/00; E05B 2047/0094; E05B 47/00; E05B 47/0649; E05B 47/0661; E05B 47/0673; E05B 13/004; E05B 2047/0024
USPC ..... 70/278.1, 278.7, 277, 279.1, 283, 472, 70/222, 223; 292/144, 201
See application file for complete search history.

(56) References Cited

U.S. PATENT DOCUMENTS 3,894,417 A * 7/1975 Taniyama ..... E05B 47/0661 70/156
4,073,527 A * 2/1978 Schlage ..... E05B 47/068 292/144
4,736,970 A * 4/1988 McGourty ..... E05B 47/0661 292/359
5,018,375 A * 5/1991 Tully ..... E05B 47/068 292/144
5,083,122 A * 1/1992 Clark ..... E05B 47/0012 340/5.22
5,421,178 A * 6/1995 Hamel ..... E05B 47/0661 292/144

(Continued)

*Primary Examiner* — Suzanne Barrett
(74) *Attorney, Agent, or Firm* — Richard J. Veltman; Adan Ayala

(57) ABSTRACT

A lock assembly includes an exterior lockset that includes an exterior operator handle. An interior lockset includes an interior operator assembly and a control electronics module. An outer spindle is operatively coupled to a latch assembly and is drivably coupled to the interior operator assembly. A locking mechanism is operatively coupled to a drive assembly, and includes a coupling mechanism and a locking spindle assembly. The coupling mechanism is configured to selectively couple the exterior operator handle to the outer spindle. The locking spindle assembly is configured to operate the coupling mechanism to transition from a locked condition to an unlocked condition by an actuation of the drive assembly. A lock position sensor is located in the interior lockset and is communicatively coupled to the control electronics module. The lock position sensor is configured to sense whether the coupling mechanism is in the locked condition or the unlocked condition.

19 Claims, 12 Drawing Sheets

(56) References Cited

U.S. PATENT DOCUMENTS 5,628,216 A * 5/1997 Qureshi ..... E05B 47/0012 292/201
5,694,798 A * 12/1997 Nunez ..... E05B 47/0661 70/224
5,782,118 A * 7/1998 Chamberlain ..... E05B 47/0012 70/277
5,933,086 A * 8/1999 Tischendorf ..... E05B 47/0661 340/12.22
5,960,656 A * 10/1999 Yao ..... E05B 47/068 70/223
6,412,318 B1 * 7/2002 Shen ..... E05B 47/0661 70/217
6,865,916 B2 * 3/2005 Goldman ..... E05B 47/0615 292/DIG. 27
6,967,562 B2 * 11/2005 Menard ..... E05B 45/06 292/346
7,003,993 B1 * 2/2006 Zehrung ..... E05B 47/0002 292/144
7,231,791 B2 * 6/2007 Sakai ..... E05B 47/0012 70/277
7,872,577 B2 * 1/2011 Frolov ..... E05B 45/06 340/5.32
7,918,114 B2 * 4/2011 Walsh, III ..... E05B 47/0661 70/223
7,963,134 B2 * 6/2011 Rafferty ..... E05B 13/00 192/69.8
8,051,689 B1 * 11/2011 Shen ..... E05B 47/068 70/224
8,302,438 B2 * 11/2012 Lui ..... E05B 47/0012 70/277
8,356,499 B2 * 1/2013 Peng ..... E05B 47/068 70/224
8,739,586 B2 * 6/2014 Yuan ..... E05B 47/026 292/144
8,887,542 B2 * 11/2014 Bogdanov ..... E05B 47/0692 464/57
2003/0160681 A1 * 8/2003 Menard ..... E05B 45/06 340/5.64
2009/0025438 A1 * 1/2009 Don ..... E05B 47/068 70/224
2009/0027197 A1 * 1/2009 Frolov ..... E05B 45/06 340/542
2014/0165677 A1 * 6/2014 Hickman ..... E05B 47/0012 70/277

* cited by examiner

LOCK ASSEMBLY HAVING LOCK POSITION SENSOR

CROSS-REFERENCE TO RELATED APPLICATIONS

This is a non-provisional application based upon U.S. provisional patent application Ser. No. 61/738,990, entitled "LOCK ASSEMBLY HAVING LOCK POSITION SENSOR", filed Dec. 18, 2012, from which priority is claimed, and which is incorporated herein by reference in its entirety.

BACKGROUND OF THE INVENTION

1. Field of the Invention

The present invention relates to door locks, and, more particularly, to a lock assembly having a lock position sensor.

2. Description of the Related Art

A door lock assembly may have a sensor arrangement to sense whether the door is in a locked or an unlocked state.

What is needed in the art is a lock assembly having a lock position sensor securely located in the interior lockset and which may use omnipolar magnetic detection. The present invention provides such a solution.

SUMMARY OF THE INVENTION

The present invention provides an interior lockset having a lock position sensor that is securely located in the interior lockset, and which may use omnipolar magnetic detection.

The invention, in one form thereof, is directed to a lock assembly for a door. The lock assembly includes an exterior lockset that includes an exterior operator assembly having an exterior operator handle. An interior lockset includes an interior operator assembly having an interior operator handle. The interior lockset has a control electronics module. A latch assembly has a bolt actuator mechanism and a bolt. An outer spindle is operatively coupled to the latch assembly and drivably coupled to the interior operator assembly. The outer spindle has a longitudinal bore. A drive assembly has a rotatable shaft. A locking mechanism is operatively coupled to the drive assembly. The locking mechanism includes a coupling mechanism and a locking spindle assembly. The coupling mechanism is configured to selectively couple the exterior operator handle to the outer spindle. The locking spindle assembly is rotatably received in the longitudinal bore and configured to operate the coupling mechanism to transition from a locked condition to an unlocked condition by an actuation of the drive assembly. A lock position sensor is located in the interior lockset and is communicatively coupled to the control electronics module. The lock position sensor is configured to sense whether the coupling mechanism is in the locked condition or the unlocked condition.

The invention, in another forth thereof, is directed to a lock assembly for a door. The lock assembly includes a latch assembly having a bolt actuator mechanism and a bolt. An outer spindle is operatively coupled to the bolt actuator mechanism of the latch assembly. The outer spindle has a first end and a second end. The outer spindle has a longitudinal bore and is configured for rotation about a first axis. An exterior lockset includes an exterior operator assembly and a credential reader. The exterior operator assembly has an exterior operator handle. A locking mechanism includes a coupling mechanism and a locking spindle assembly. The coupling mechanism is drivably coupled to the second end of the outer spindle and is configured to selectively couple the exterior operator handle to the outer spindle. The locking spindle assembly is rotatably received in the longitudinal bore of the outer spindle for rotation about the first axis. The locking spindle assembly includes a locking spindle tail member that extends from the first end of the outer spindle. A locking actuator spindle extends from the second end of the outer spindle. The locking actuator spindle is configured to selectively operate the coupling mechanism to drivably couple the exterior operator assembly to the outer spindle. An interior lockset includes an interior operator assembly, a control electronics module, and a motor drive assembly. The interior operator assembly includes an interior operator handle drivably coupled to the first end of the outer spindle. The control electronics module is electrically coupled to the motor drive assembly and the credential reader. The credential reader is configured to selectively actuate the motor drive assembly. The motor drive assembly includes a motor having a motor shaft rotatable about the first axis. The motor shaft is drivably coupled to the locking spindle tail member of the locking spindle assembly to operate the coupling mechanism when the motor drive assembly is actuated. A lock position sensor is configured to sense whether a lock status of the locking mechanism is in a locked condition or in an unlocked condition. The lock position sensor includes a sensor cam, a sensing mechanism, and an Omnipolar Hall Effect Sensor. The sensor cam has a cam surface. The sensor cam is drivably interposed between the motor shaft of the motor drive assembly and the locking spindle tail member of the locking spindle assembly. The sensing mechanism includes a magnet having a North pole and a South pole. The sensing mechanism is configured to change a position of the magnet based on a rotational position of the sensor cam. The rotational position of the sensor cam is indicative of the lock status of the lock assembly. The Omnipolar Hall Effect Sensor is configured to detect a presence or an absence of a magnetic field produced by the magnet. The Omnipolar Hall Effect Sensor is configured to provide electrical outputs to the control electronics module that correspond to the lock status of the lock assembly.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION OF THE INVENTION

Figure 1:
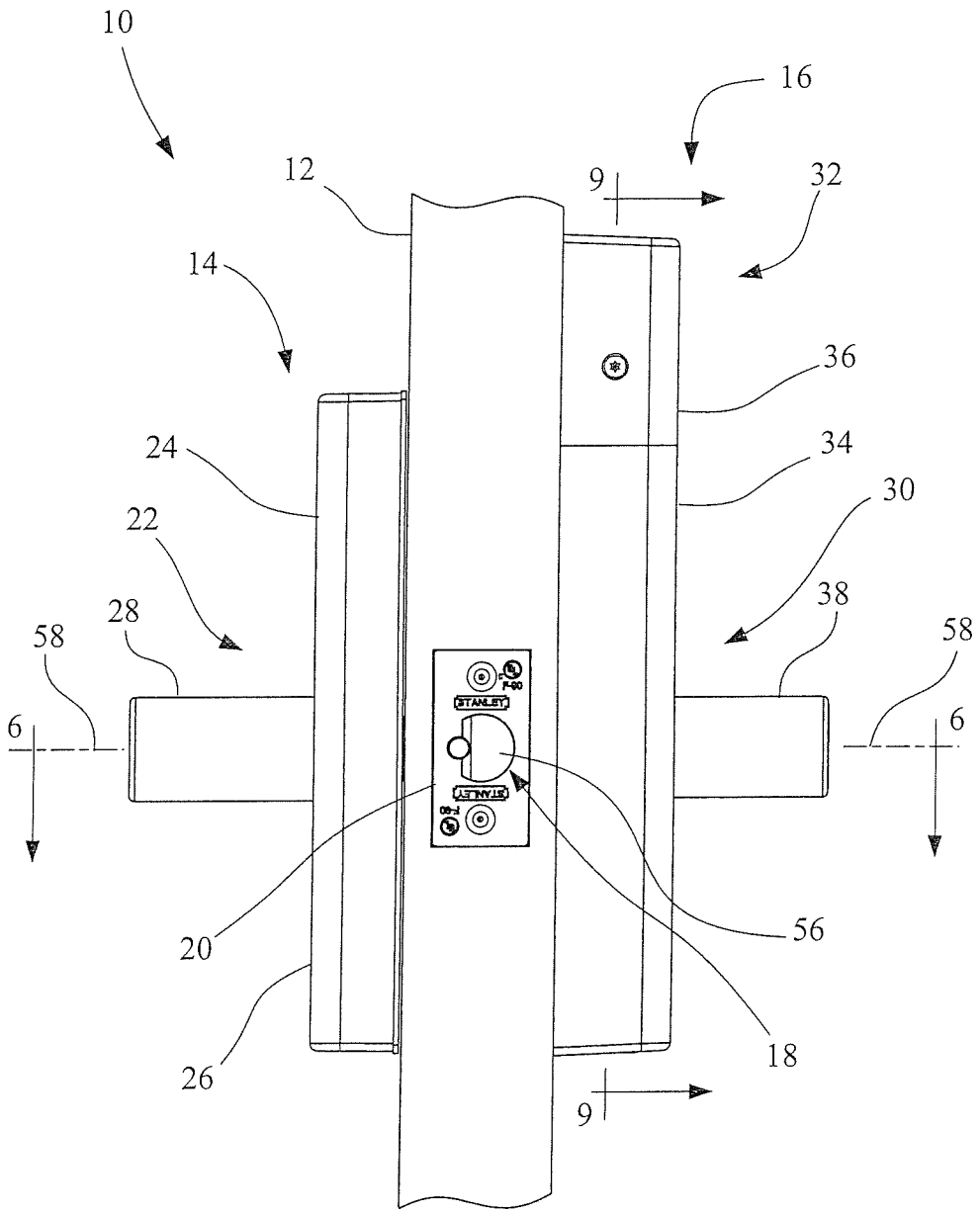
FIG. 1 is a door edge view of a lock assembly in accordance with an embodiment of the present invention, installed on a door.
Figure 2:
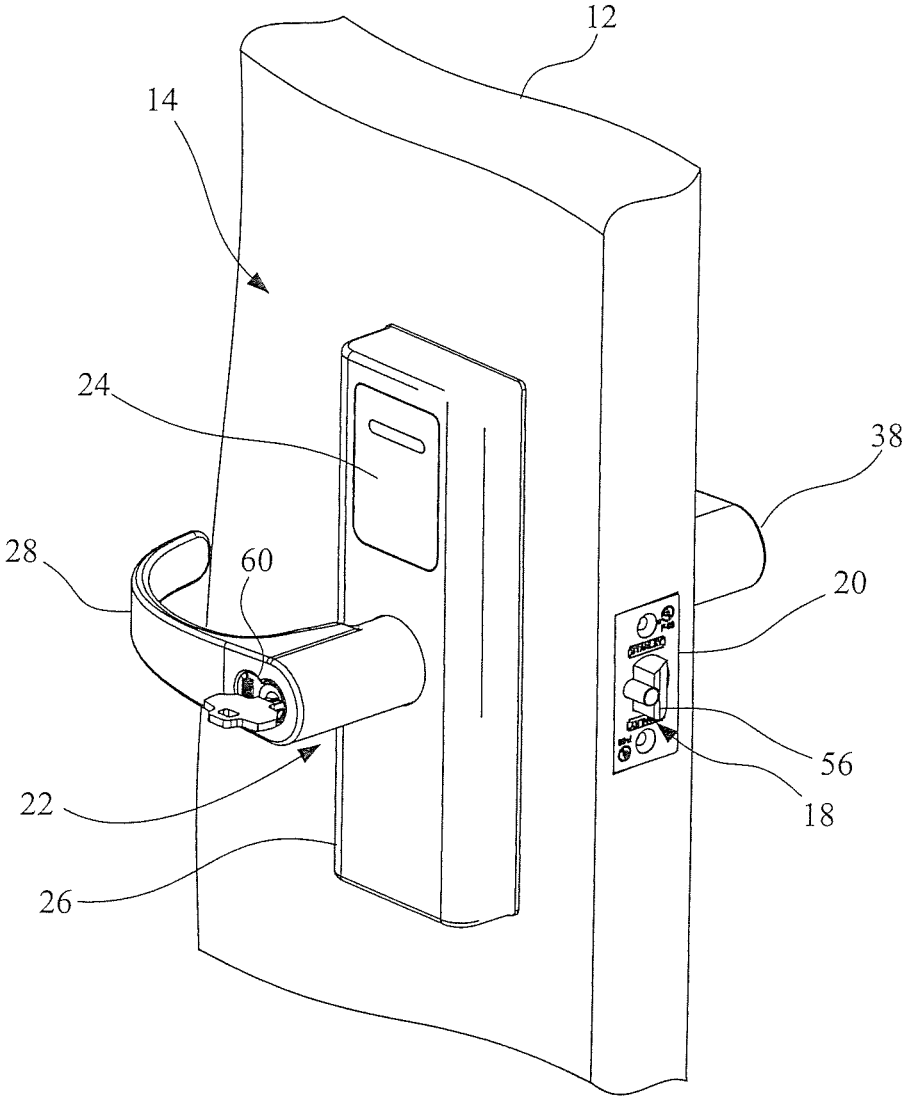
FIG. 2 is a perspective view of the exterior lockset of the lock assembly of FIG. 1, as viewed from the exterior of the door.
Figure 3:
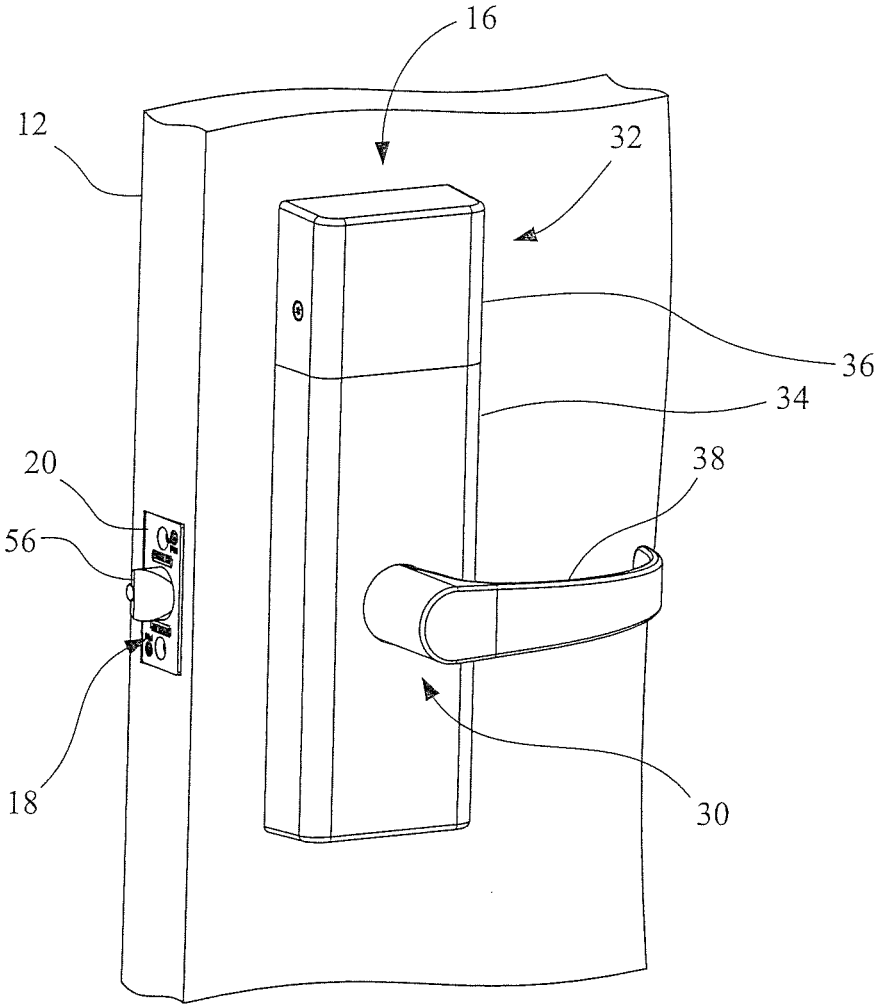
FIG. 3 is a perspective view of the interior lockset of the lock assembly of FIG. 1, as viewed from the interior of the door.

Referring now to the drawings and particularly to FIGS. 1-3, there is shown a lock assembly 10 in accordance with the present invention for mounting on a door 12, and which includes an exterior lockset 14, an interior lockset 16, a latch assembly 18, and a strike 20.

Exterior lockset 14 includes an exterior operator assembly 22, a credential reader 24, and an exterior escutcheon 26. Exterior operator assembly 22 includes an exterior operator handle 28.

Interior lockset 16 includes an interior operator assembly 30, a control electronics module 32, an interior escutcheon 34, and a battery cover 36. Interior operator assembly 30 includes an interior operator handle 38. Control electronics module 32 is electrically connected to credential reader 24. Control electronics module 32 may include, for example, a processing unit (e.g., a microcontroller), a memory unit, and input/output circuitry. The processing unit may include a commercially available microprocessor or a custom built processing unit in the form of an application specific integrated circuit (ASIC) and associated input/output (I/O) circuitry.

Figure 4:
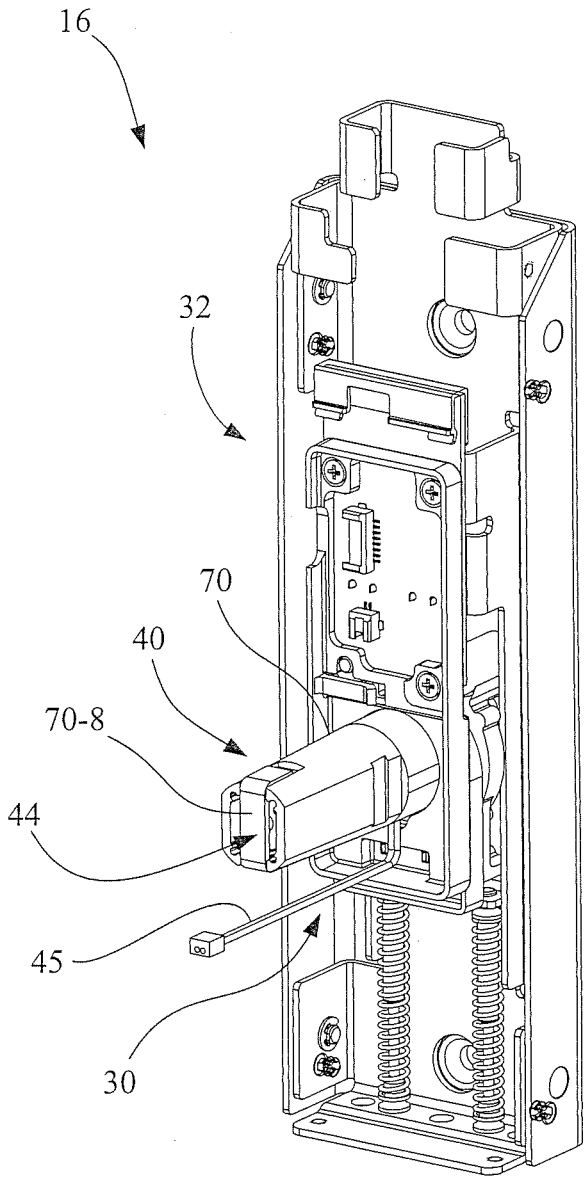
FIG. 4 is a perspective view of the interior lockset of FIG. 3, with the operator lever, escutcheon, and battery cover removed.
Figure 5:
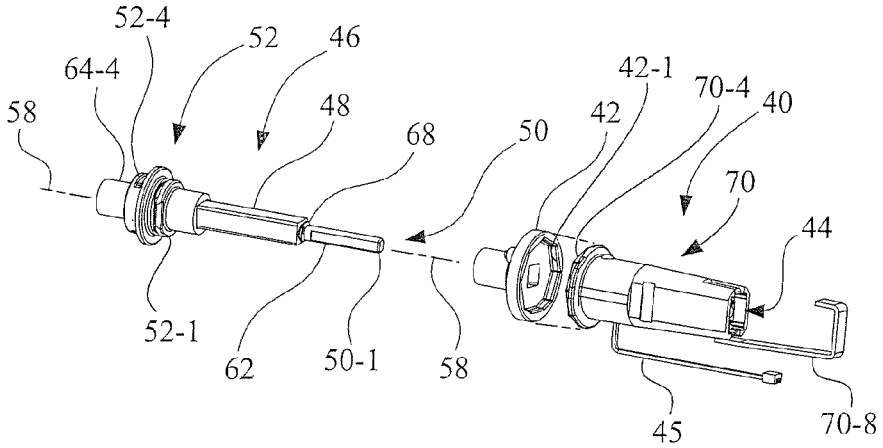
FIG. 5 is an exploded view of the handle sleeve assembly and spindle assembly of the lock assembly of FIG. 1.

Referring also to FIG. 4, interior operator assembly 30 includes a handle sleeve assembly 40. An exterior of handle sleeve assembly 40 is configured to mount interior operator handle 38. Referring also to FIG. 5, a distal end of handle sleeve assembly 40 is drivably coupled to an inside square drive spindle coupler 42. Within handle sleeve assembly 40 there is a chamber for mounting a motor drive assembly 44. Motor drive assembly 44 is electrically connected to control electronics module 32 via wire conductors 45.

Also shown in FIG. 5 is a spindle assembly 46 that includes an outer square spindle 48 within which there is rotatably received a locking spindle assembly 50. A coupling mechanism 52 is provided to selectively drivably couple exterior operator assembly 22 to outer square spindle 48. Locking spindle assembly 50 has a first end 50-1 that is mechanically coupled to a rotatable shaft of motor drive assembly 44. Locking spindle assembly 50 is operably coupled to coupling mechanism 52 to selectively couple and decouple exterior operator assembly 22 to outer square spindle 48, with the normal, or rest, state being a decoupled state.

Figure 6:
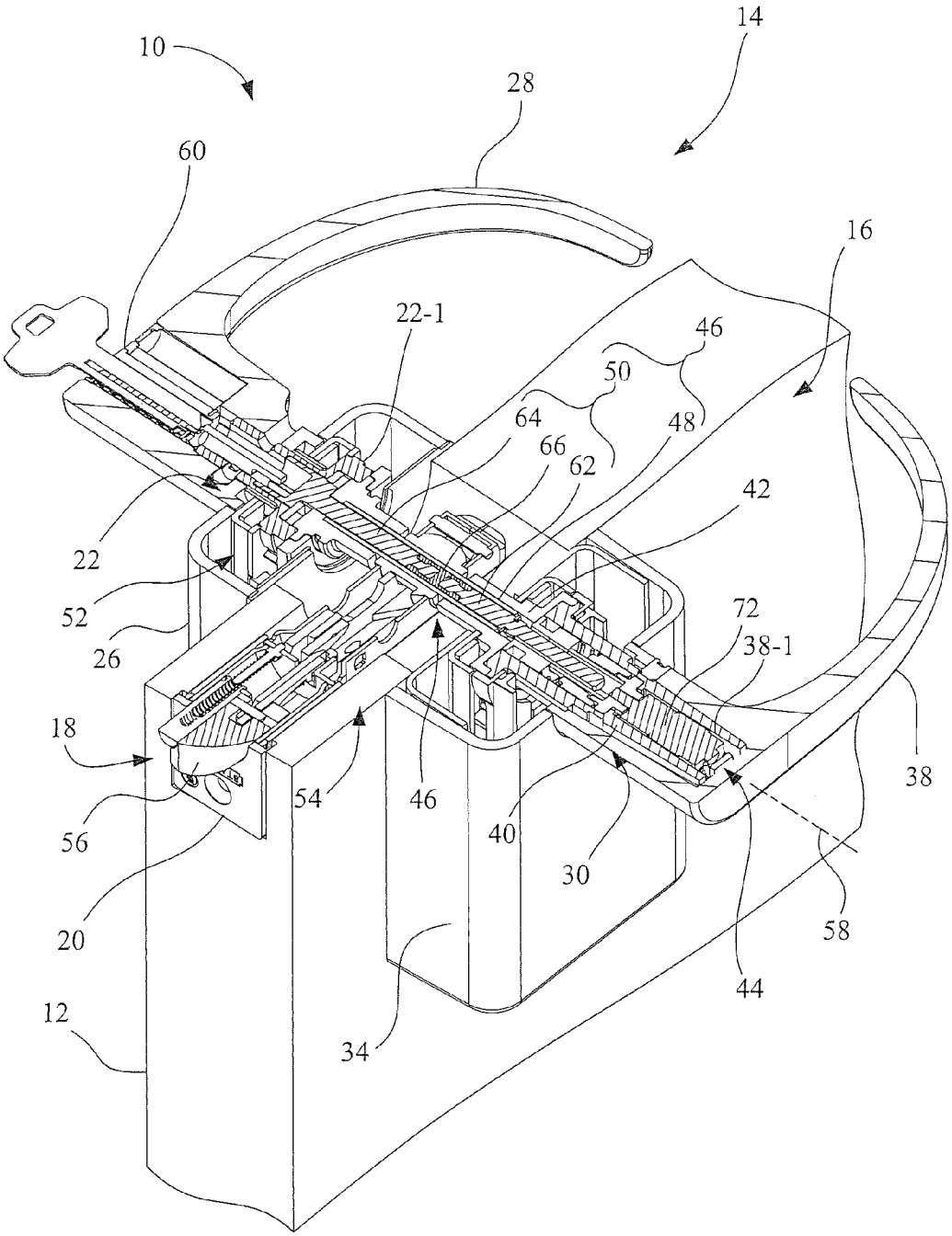
FIG. 6 is a sectioned perspective view of the lock assembly of FIG. 1 taken along plane 6-6 of FIG. 1.

Referring also to FIG. 6, latch assembly 18 is configured with a bolt actuator mechanism 54 and a retractable bolt 56, as is customary in the art. Bolt actuator mechanism 54 is operable by a rotation of outer square spindle 48 of spindle assembly 46 to retract bolt 56. As is illustrated in FIG. 6, exterior operator handle 28, interior operator handle 38, motor drive assembly 44 and spindle assembly 46 are longitudinally aligned along an axis 58.

Interior lockset 16 is configured such that during normal operation interior operator handle 38 is always operatively coupled to spindle assembly 46, and in particular, to outer square spindle 48 via inside square drive spindle coupler 42, and in turn to latch assembly 18. As such, in normal operation a rotation of interior operator handle 38 always will result in a retraction of bolt 56. Also, in normal operation motor drive assembly 44 is always operatively coupled to locking spindle assembly 50.

Referring to FIGS. 2 and 6, exterior lockset 14 is configured such that exterior operator handle 28 is selectively coupled to latch assembly 18. In a locked condition, exterior operator handle 28 is decoupled from spindle assembly 46, and thus a rotation of exterior operator handle 28 does not result in a retraction of bolt 56. In an unlocked condition, exterior operator handle 28 is coupled to spindle assembly 46 via coupling mechanism 52 to operate latch assembly 18, and thus a rotation of exterior operator handle 28 will result in a retraction of bolt 56.

The unlocked condition may be achieved by providing a valid credential, e.g., an RFID card, to be read by credential reader 24, which in turn sends a signal to control electronics module 32. Control electronics module 32 then compares the read credential to a database of stored authorized credentials, and if a match is found, responds by operating motor drive assembly 44 to rotate the inner portion, i.e., locking spindle assembly 50, of spindle assembly 46 to activate coupling mechanism 52 to couple exterior operator handle 28 to latch assembly 18 via coupling mechanism 52 and outer square spindle 48 (see also FIG. 5).

Additionally, exterior lockset 14 is provided with a mechanical override in the form of a key operated interchangeable keyed lock core 60 that is operatively coupled to coupling mechanism 52, such that a valid operator key may be used to effect a coupling of exterior operator handle 28 to latch assembly 18.

Figure 7:
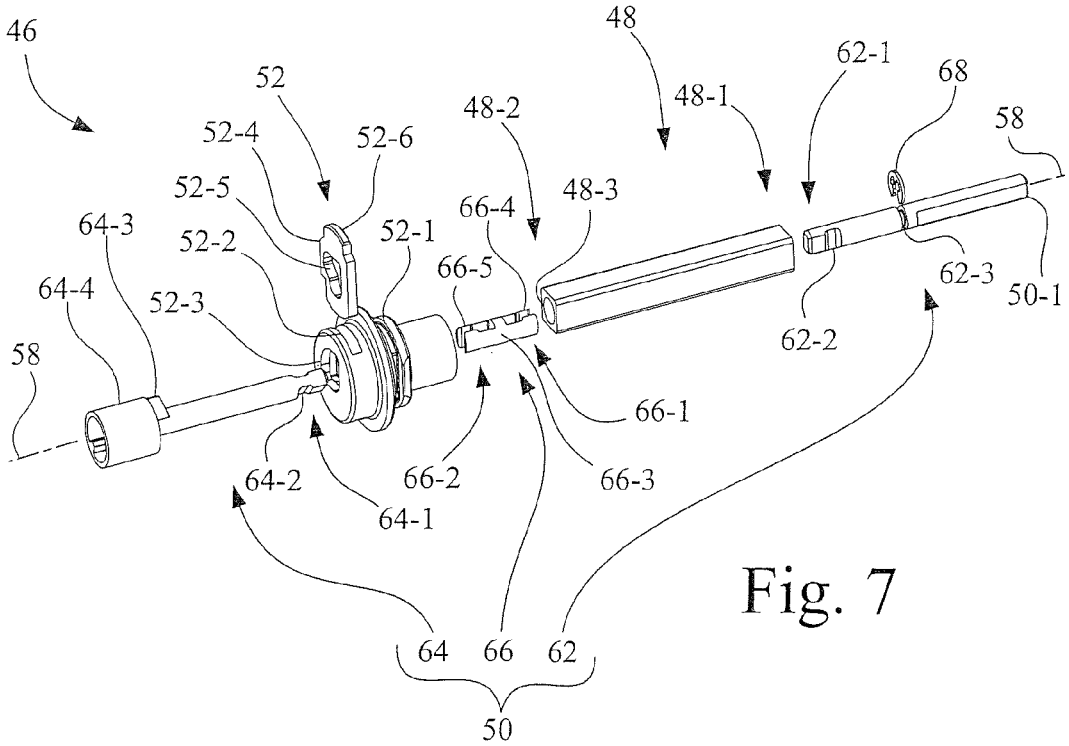
FIG. 7 is an exploded view of the spindle assembly of FIG. 5.

Referring now also to FIG. 7, spindle assembly 46 includes the outer square spindle 48. Outer square spindle 48 has a first end 48-1, a second end 48-2, and a longitudinal bore 48-3 that extends between first end 48-1 and second end 48-2. Longitudinal bore 48-3 of outer square spindle 48 is sized to rotatably receive locking spindle assembly 50. Second end 48-2 of outer square spindle 48 is configured to drivably connect to a body 52-1 of coupling mechanism 52.

Body 52-1 of coupling mechanism 52 includes a slot 52-2 and a longitudinal opening 52-3. Longitudinal opening 52-3 is co-axial with longitudinal bore 48-3 along axis 58. Slot 52-2 is arranged to perpendicularly intersect longitudinal opening 52-3. A slide member 52-4 is received in slot 52-2 in a sliding arrangement, such that slide member 52-4 is selectively extendable from body 52-1. Slide member 52-4 has a cam opening 52-5 and a coupling tab 52-6. Coupling tab 52-6 is configured to selectively engage a coupling portion 22-1 of exterior operator assembly 22, such that when so engaged, exterior operator handle 28 is rotatably coupled to outer square spindle 48 to operate latch assembly 18.

Locking spindle assembly 50 is a three piece elongate sub-assembly, generally round in cross-section, which transfers a torque function that is required to lock and unlock lock assembly 10 via the lifting and lowering of slide member 52-4 of coupling mechanism 52. More particularly, locking spindle assembly 50 includes a locking spindle tail 62, a locking actuator spindle 64, and a locking spindle link 66. Each of locking spindle tail 62, locking actuator spindle 64, and locking spindle link 66 has a cylindrical exterior portion that is received in a snug rotating fit within the longitudinal bore 48-3 of outer square spindle 48.

Locking spindle tail 62 has a coupling end 62-1 having a pair of diametrically opposed surface recesses 62-2. Likewise, locking actuator spindle 64 has a coupling end 64-1 having a pair of diametrically opposed surface recesses 64-2. In addition, locking actuator spindle 64 includes a cam protrusion 64-3 that is configured to be received in cam opening 52-5 of body 52-1 of coupling mechanism 52, so as to raise or lower slide member 52-4 based on a rotational position of cam protrusion 64-3. A head portion 64-4 of locking actuator spindle 64 is located opposite coupling end 64-1, with cam protrusion 64-3 interposed between head portion 64-4 and coupling end 64-1, and with cam protrusion 64-3 adjacent head portion 64-4.

Locking spindle link 66 is configured as an H-shaped structure having a pair of axially opposed U-shaped clip ends 66-1 and 66-2 that are separated by an interposed solid core 66-3. U-shaped clip end 66-1 includes a pair of diametrically opposed inwardly facing protrusions 66-4 sized and configured to engage the corresponding pair of diametrically opposed surface recesses 62-2 of locking spindle tail 62 in an interlocking and/or a snap fit, so as to connect locking spindle link 66 to locking spindle tail 62. U-shaped clip end 66-2 includes a pair of diametrically opposed inwardly facing protrusions 66-5 sized and configured to engage the corresponding pair of diametrically opposed surface recesses 64-2 of locking actuator spindle 64 in an interlocking and/or a snap fit, so as to connect locking spindle link 66 to locking actuator spindle 64.

Referring particularly to FIG. 7, to assemble spindle assembly 46, coupling end 64-1 of locking actuator spindle 64 is inserted through longitudinal opening 52-3 of body 52-1 of coupling mechanism 52, and through cam opening 52-5 of slide member 52-4. Head portion 64-4 serves as a stop to engage coupling mechanism 52 to position cam protrusion 64-3 in cam opening 52-5 of slide member 52-4. Coupling end 64-1 of locking actuator spindle 64 is then connected to U-shaped clip end 66-2 of locking spindle link 66. Coupling end 62-1 of locking spindle tail 62 is then connected to U-shaped clip end 66-1 of locking spindle link 66.

Locking spindle assembly 50 is then inserted, first end 50-1 first, through longitudinal bore 48-3 of outer square spindle 48, such that second end 48-2 of outer square spindle 48 drivably engages body 52-1 of coupling mechanism 52. A snap ring 68 is inserted into a snap ring groove 62-3 of locking spindle tail 62. The resulting assembled arrangement of spindle assembly 46 is illustrated in FIG. 5.

To aid in preventing the spread of fire, each of the outer square spindle 48 of spindle assembly 46 and the inner locking spindle link 66 of locking spindle assembly 50 that is received in longitudinal bore 48-3 of outer square spindle 48 may be made of a material having a relatively high melting temperature, such as steel or similar alloy. Each of locking spindle tail 62 and locking actuator spindle 64 may made of a non-steel material, such as zinc, aluminum, polymer, or other non-ferrous suitable alloy, having a relatively lower melting temperature.

Alternatively, the entirety of spindle assembly 46 may be made of steel or similar alloy having a relatively high melting temperature, and other fire safety features known in the art may be employed.

Referring to FIGS. 4-6 and 8, handle sleeve assembly 40 includes a housing 70 that contains and mounts motor drive assembly 44.

Motor drive assembly 44 includes a motor 72 and a clutch assembly 74 that are axially arranged along axis 58. Thus, direct axial rotational output from motor 72 of motor drive assembly 44 is used to drive locking spindle assembly 50 via clutch assembly 74, and in turn to operatively drive coupling mechanism 52 (see FIGS. 5-7) to effect locking and unlocking of lock assembly 10. Clutch assembly 74 of motor drive assembly 44 allows the output torque from motor 72 to be transmitted to the three piece locking spindle assembly 50, but also will clutch, i.e., slip, and will allow the motor shaft of motor 72 to spin freely if there is enough resistance from the slide member 52-4, i.e., locking plate, of coupling mechanism 52 in attempting to move slide member 52-4 into a locked or unlocked position.

Housing 70 of handle sleeve assembly 40 has a proximal end 70-1 and a distal end 70-2, and has a slight taper between proximal end 70-1 and distal end 70-2. Housing 70 has an exterior shape including a plurality of flats 70-3 that corresponds to an interior shape of a mounting opening 38-1 in interior operator handle 38 to mount interior operator handle 38. At distal end 70-2 there is a multi-faceted polygonal male driver 70-4 configured to engage a corresponding driven opening 42-1 in the inside square drive spindle coupler 42 (see FIG. 5).

Housing 70 is hollow and includes a side wall 70-5 that defines a chamber 70-6 configured to receive and mount motor drive assembly 44. A portion of chamber 70-6 at proximal end 70-1 is substantially rectangular to match the exterior profile of motor 72 so as to prevent a rotational movement of motor 72 relative to housing 70. Proximal to distal end 70-2 there is formed a bore 70-7 in side wall 70-5 that is arranged perpendicular to axis 58, i.e., radially oriented, and is configured to slidably receive a sensor pin 73. A sliding clip 70-8 is used to axially retain motor drive assembly 44 in chamber 70-6 of housing 70.

Figure 8:
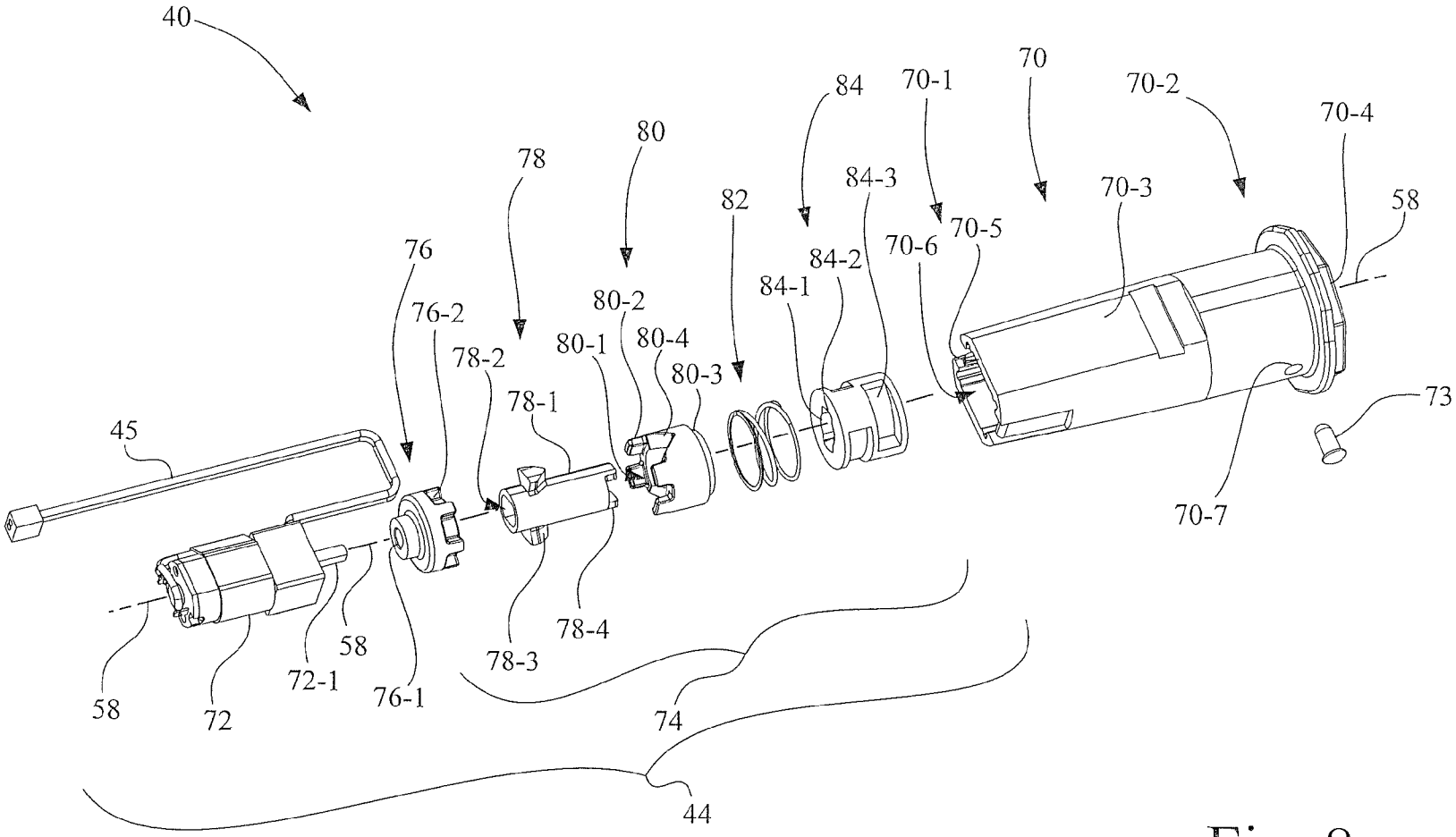
FIG. 8 is an exploded view of the handle sleeve assembly of FIGS. 4-6.

Referring to FIGS. 4 and 8, motor 72 is electrically connected to control electronics module 32 via the wire conductors 45. Motor 72 includes a rotatable motor shaft 72-1 which is drivably connected to clutch assembly 74. Motor 72 may be, for example, a DC motor.

As shown in FIG. 8, clutch assembly 74 includes a motor clutch base 76, a motor clutch driver 78, a motor clutch 80, a motor clutch compression spring 82, and a sensor cam 84.

Motor clutch base 76 has an opening 76-1 that is mounted, e.g., in a press fit, to motor shaft 72-1 of motor 72. Motor clutch base 76 has a plurality of distal peripheral drive notches 76-2 located around the periphery of motor clutch base 76.

Motor clutch 80 includes a center bore 80-1, a plurality of proximal peripheral tabs 80-2 located around the periphery of the motor clutch 80, a distal annular recess 80-3 and a pair of diametrically opposed cam surfaces 80-4. The plurality of proximal peripheral tabs 80-2 is configured to be drivably received by the plurality of distal peripheral drive notches 76-2 of motor clutch base 76.

Axially interposed between motor clutch base 76 and motor clutch 80 is motor clutch driver 78. Motor clutch driver 78 includes an elongate shaft 78-1 having a drive opening 78-2 having drive flats, and is configured to drivably receive first end 50-1 of locking spindle tail 62 of locking spindle assembly 50 (see FIGS. 5 and 7). As such, a rotation of motor clutch driver 78 results in a direct rotation of locking spindle assembly 50. Extending radially outward from elongate shaft 78-1 is a pair of diametrically opposed cam protrusions 78-3 configured to be drivably engaged with the diametrically opposed cam surfaces 80-4 of motor clutch 80. Motor clutch driver 78 further includes a pair of diametrically opposed distal drive tabs 78-4.

Figure 9:
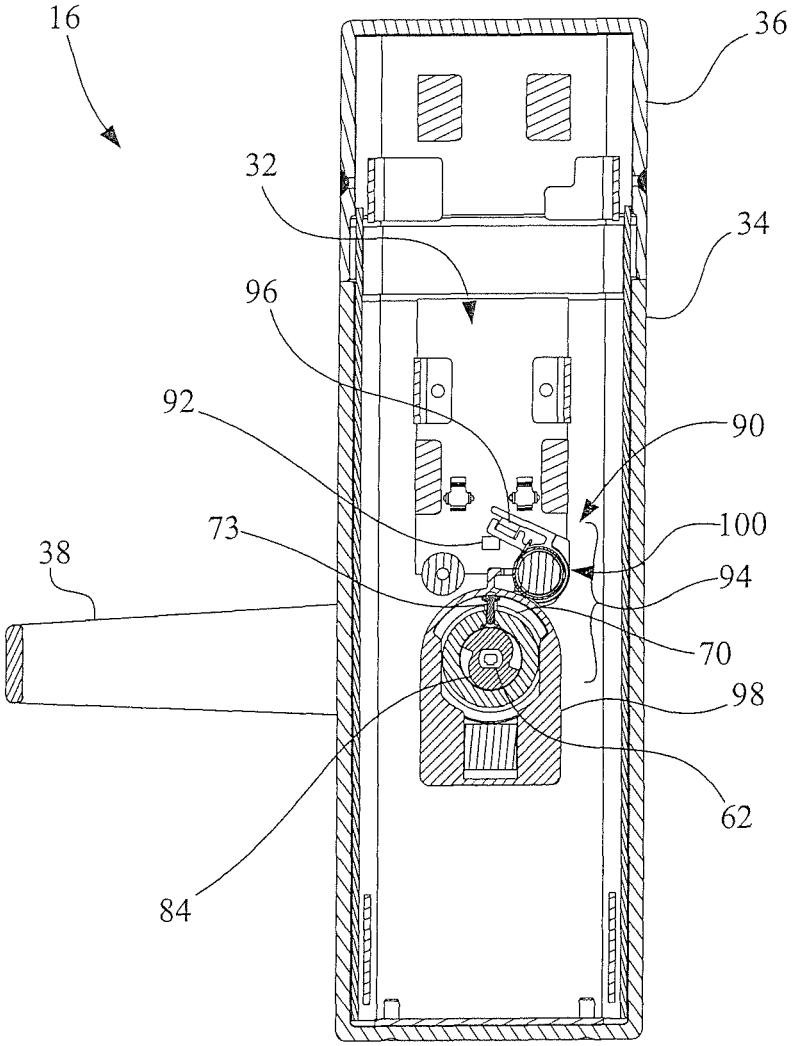
FIG. 9 is a sectioned view through the interior lockset of the lock assembly of FIG. 1 taken along plane 9-9 of FIG. 1, showing the lock position sensor of the present invention.
Figure 10:
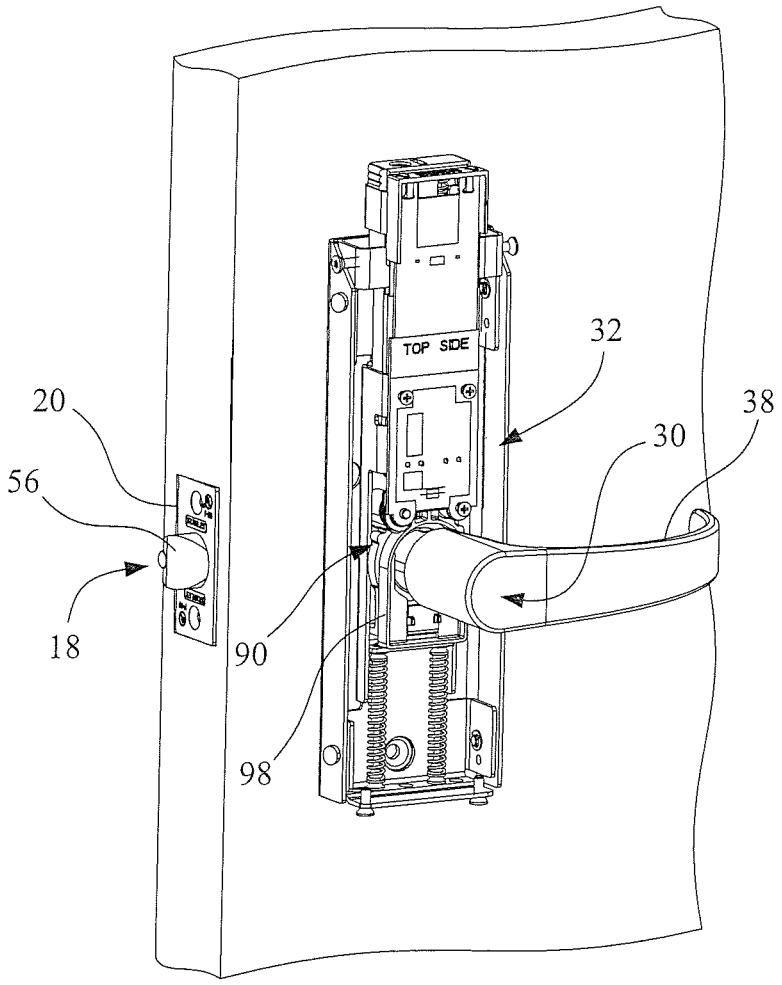
FIG. 10 is a perspective view of the interior lockset of FIG. 3, with the escutcheon, battery cover, and other components removed to expose the sensor pin guide of the lock position sensor shown in FIG. 9.

Sensor cam 84 includes an opening 84-1 through which locking spindle tail 62 of locking spindle assembly 50 passes (see also FIGS. 5 and 9). Opening 84-1 has a pair of diametrically opposed notches 84-2 configured to receive the pair of diametrically opposed distal drive tabs 78-4 of motor clutch driver 78.

Sensor cam 84 also includes a circumferential cam surface 84-3 which is engaged by sensor pin 73. A rotational position of circumferential cam surface 84-3 of sensor cam 84 is dependent on a rotational position of locking spindle assembly 50. Based on a rotational position of circumferential cam surface 84-3 of sensor cam 84, sensor pin 73 is raised or lowered (radially, e.g., vertically, displaced) in the vertically oriented bore 70-7, which is indicative of the lock status (locked condition or unlocked condition) of lock assembly 10. In other words, as a result of following circumferential cam surface 84-3, sensor pin 73 is used to provide feedback to control electronics module 32 as to whether lock assembly 10 is in a locked or an unlocked state.

Motor clutch compression spring 82 is interposed between motor clutch 80 and sensor cam 84. More particularly, motor clutch compression spring 82 is received around elongate shaft 78-1 of motor clutch driver 78, and is fitted over distal annular recess 80-3 of motor clutch 80 to maintain the radial position of motor clutch compression spring 82.

In summary from the discussion above, lock assembly is normally in a locked condition, i.e., in a motor non-energized state, such that slide member 52-4 of coupling mechanism 52 is in its retracted position and a rotation of exterior operator handle 28 will not result in a retraction of bolt 56. However, to effect the unlocked condition wherein a rotation of exterior operator handle 28 will result in a retraction of bolt 56, motor 72 is energized to rotate clutch assembly 74, including sensor cam 84, and in turn to rotate locking spindle assembly 50 to extend slide member 52-4 of coupling mechanism 52.

Referring now to FIGS. 8-14, a lock position sensor 90 with omnipolar magnetic detection is provided to sense whether lock assembly 10 is in the locked or unlock condition, and more specifically, whether the lock mechanism formed from the locking spindle assembly 50 and the coupling mechanism 52, including the slide member, i.e., locking plate, 52-4, is in the locked or the unlocked position.

Referring to FIG. 9, lock position sensor 90 includes an Omnipolar Hall Effect Sensor 92 electrically integrated into control electronics module 32. Lock position sensor 90 further includes a sensing mechanism 94 configured to change a position of a magnet 96 (see also FIGS. 12-14) having a North pole N and a South pole S, relative to Omnipolar Hall Effect Sensor 92.

Omnipolar Hall Effect Sensor 92 is used to detect the presence or absence of a magnetic field produced by magnet 96. Omnipolar Hall Effect Sensor 92 is a single device having two different outputs utilized by control electronics module 32. One output represents the North pole N due to flux in one certain direction. The other output represents the South pole S, due to the South pole magnetic field being in the opposite direction from that of the North pole. Omnipolar Hall Effect Sensor 92 is a null position hall effect sensor, wherein the distance away from the magnet 96 that denotes magnetic field presence or absence is the same every time.

Referring particularly to FIGS. 8 and 9, sensing mechanism 94 includes sensor pin 73 and sensor cam 84 of clutch assembly 74 previously described above. In addition, referring also to FIGS. 10-14, sensing mechanism 94 includes a sensor pin guide 98 and a magnet holder 100.

Figure 12:
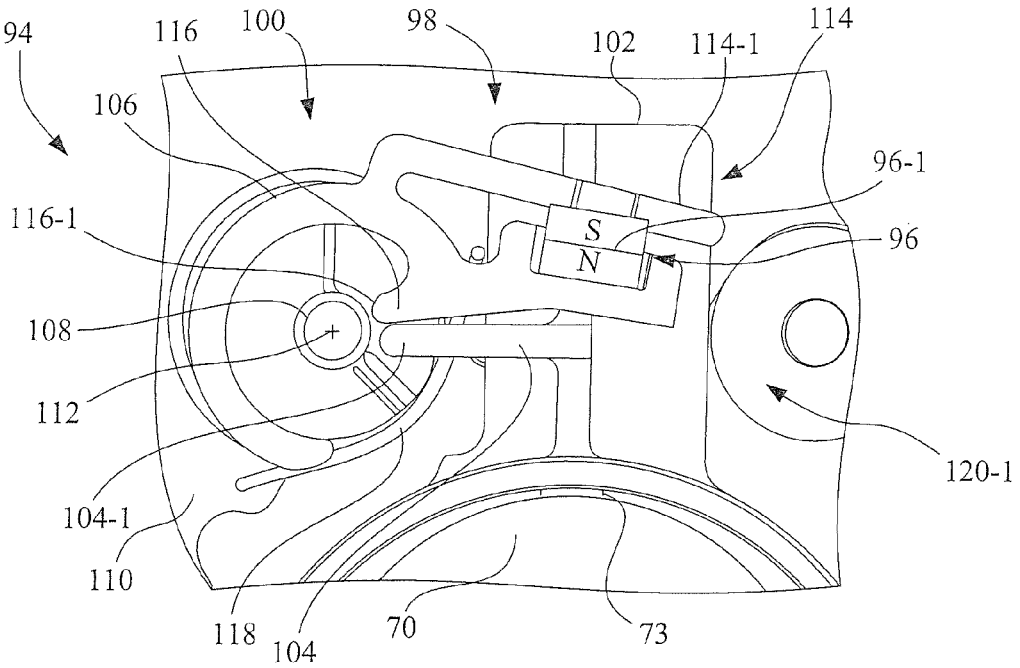
FIG. 12 is an enlarged side view showing the lock position sensor with the magnet in the lowered position.
Figure 13:
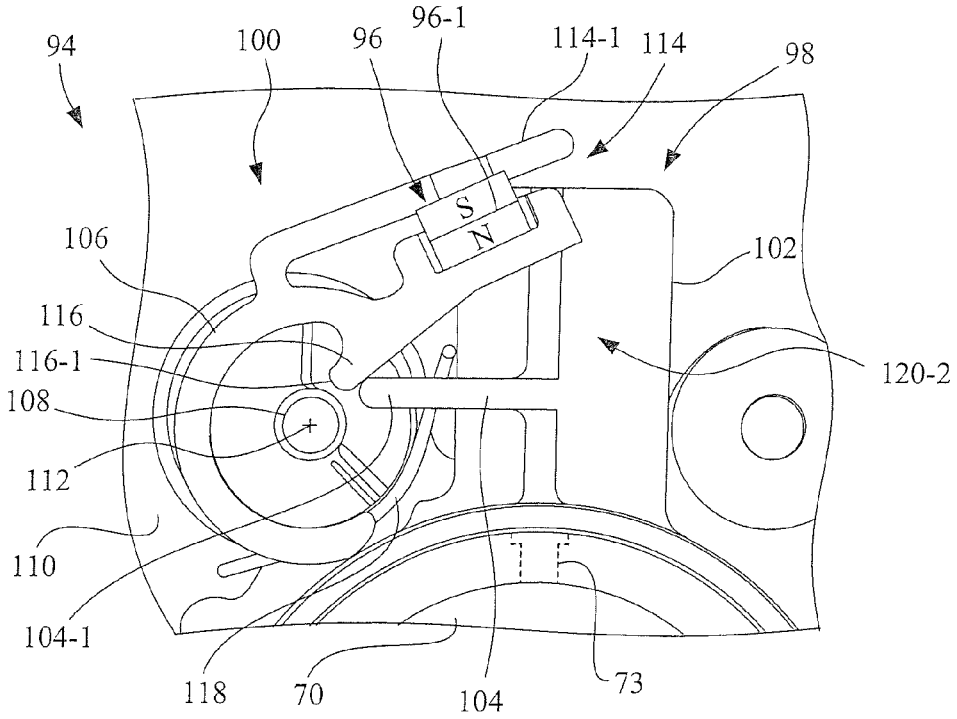
FIG. 13 is an enlarged side view showing the lock position sensor with the magnet in the raised position.

Sensor pin guide 98 is configured as a linearly (vertically) movable slide having a vertical position that depends on whether sensor pin 73 is retracted as shown in FIG. 12, or is extended as shown in FIGS. 9 and 13. Referring particularly to FIGS. 12 and 13, sensor pin guide 98 includes a lift member 102 configured as a vertically extending member that is vertically displaced by movement of sensor pin 73. A cantilever sensor arm 104 extends perpendicularly from lift member 102 and has a distal end 104-1 positioned to engage magnet holder 100.

Magnet holder 100 includes a rotatable base 106 configured to rotate about a pin 108 that extends from a chassis 110 of interior lockset 16. Pin 108 extends along an axis 112 that is substantially parallel to axis 58. Rotatable base 106 includes a cantilever arm arrangement 114 radially displaced vertically and horizontally from axis 112. Cantilever arm arrangement 114 includes a distal end 114-1 configured to mount magnet 96. A follower 116 extends inwardly from cantilever arm arrangement 114 toward axis 112, and has a terminal end 116-1 spaced a distance from axis 112. Follower arm 116 is positioned to engage distal end 104-1 of cantilever sensor arm 104 of sensor pin guide 98.

A torsion spring 118 rotationally biases follower arm 116 of magnet holder 100 into contact with cantilever sensor arm 104 of sensor pin guide 98.

In the component arrangement depicted in FIG. 12, the position of sensor pin 73, sensor pin guide 98, magnet holder 100 and magnet 96 are positioned in the lowered position 120-1 to correspond to the locked condition of lock assembly 10. In the component arrangement depicted in FIGS. 9 and 13, the position of sensor pin 73, sensor pin guide 98, magnet holder 100 and magnet 96 are positioned in the raised position 120-2 to correspond to the unlocked condition of lock assembly 10, wherein sensor pin 73 has been lifted by the rotational torque supplied by motor 72 and sensor cam 84 of clutch assembly 74 (see also FIG. 8). Following the unlocked condition, the rotational direction of motor 72 is reversed such that the position of sensor cam 84, and in turn sensor pin 73, sensor pin guide 98, magnet holder 100 and magnet 96, are returned to the locked condition of lock assembly 10.

Figure 11:
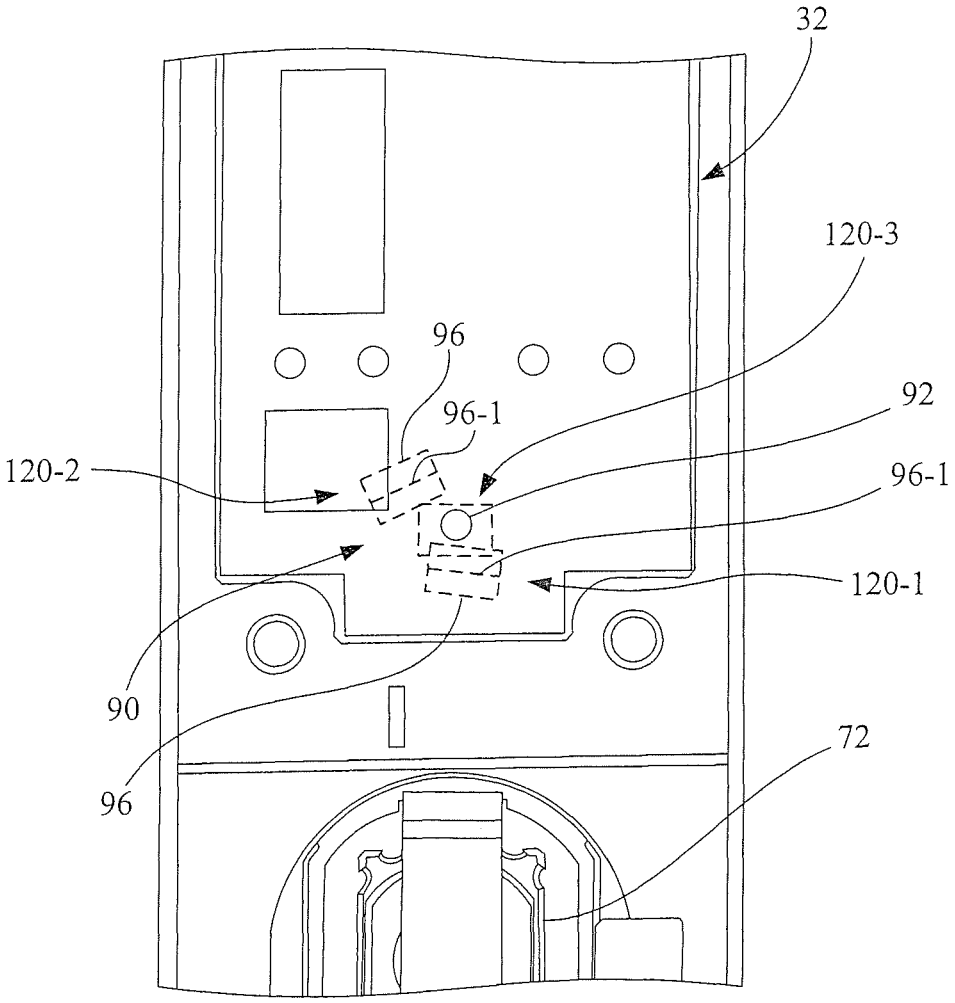
FIG. 11 is a diagrammatic representation of the raised, null and lowered positions of the magnet in relation to an Omnipolar Hall Effect Sensor.
Figure 14:
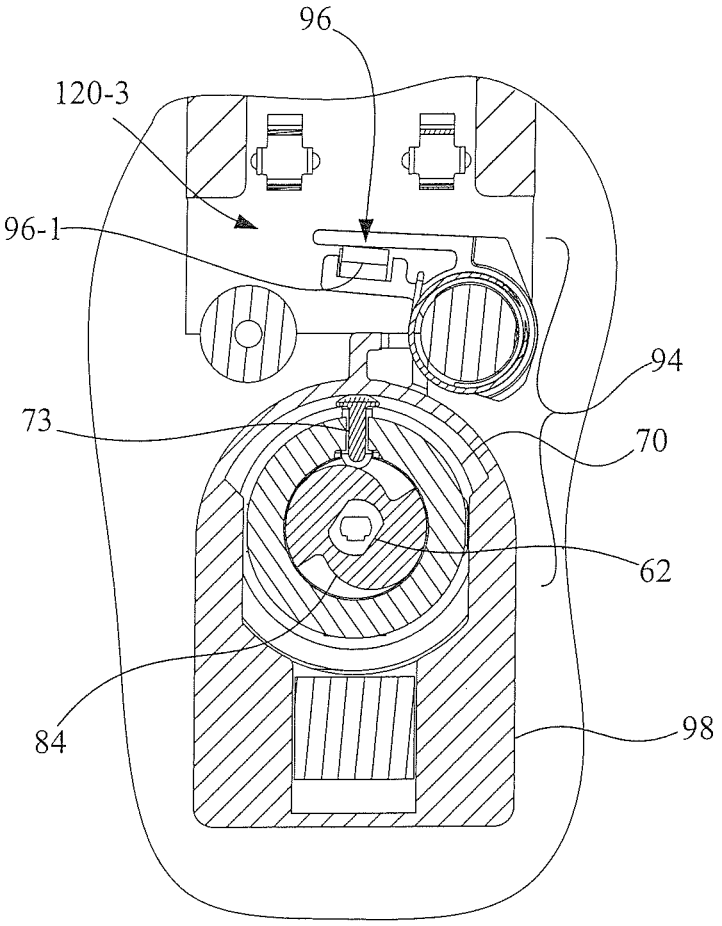
FIG. 14 is an enlarged view of a portion broken away from the view shown in FIG. 9, but with the magnet in the null position.

In operation, the two positions of magnet 96 (lowered position 120-1, FIG. 12; raised position 120-2, FIG. 13) need to be detected. The lowered position 120-1 of magnet 96 indicates the locked condition of lock assembly 10. The raised position 120-2 of magnet 96 indicates the unlocked condition of lock assembly 10. When the motor shaft 72-1 of motor 72 is rotated back and forth, magnet 96 is moved across Omnipolar Hall Effect Sensor 92. The center of magnet 96 between North pole N and South pole S is referred to herein as a null point 96-1, due to the fact that there is an absence of magnetic flux. As illustrated in FIGS. 11 and 14, Omnipolar Hall Effect Sensor 92 is located at a null position 120-3, such that the null point 96-1 of magnet 96 is directly over Omnipolar Hall Effect Sensor 92 at the halfway travel point between the lowered position 120-1 of magnet 96 and the raised position 120-2 of magnet 96.

As magnet 96 is moved off center towards the North pole N, the North output of Omnipolar Hall Effect Sensor 92 will be activated once the Operating Point of Omnipolar Hall Effect Sensor 92 is reached. This will indicate the lowered (locked) position 120-1 of the components to in turn indicate that the locked condition of lock assembly 10 is reached. When motor shaft 72-1 of motor 72 is driven in the opposite direction, the North sensor output of Omnipolar Hall Effect Sensor 92 will deactivate once the Release Point of Omnipolar Hall Effect Sensor 92 is reached. As the South pole S of magnet 96 moves into the Operating Point range, the South output of Omnipolar Hall Effect Sensor 92 will be activated, which will indicate the raised (unlocked) position 120-2 of the components to in turn indicate that the unlocked condition of lock assembly 10 has been reached.

Omnipolar Hall Effect Sensor 92 is a low power device that wakes up from a dormant state every 40 ms (typ.) and checks for magnetic field presence. The awake time is 50 us (typ.). The two sensor outputs of Omnipolar Hall Effect Sensor 92 are connected to wake up/interrupt pins on the microcontroller of control electronics module 32, and provide the indication of the locked and unlocked conditions. The indications of the locked and unlocked conditions may be used by control electronics module 32 to provide a lock status to an external device, or may be used internally to detect a fault condition of lock assembly 10.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A lock assembly for a door, comprising:

an exterior lockset including an exterior operator assembly having an exterior operator handle;

an interior lockset including an interior operator assembly having an interior operator handle, the interior lockset having a control electronics module;

a latch assembly having a bolt actuator mechanism and a bolt;

an outer spindle operatively coupled to the latch assembly, drivably coupled to the interior operator assembly, and the outer spindle having a longitudinal bore;

a drive assembly having a rotatable shaft;

a locking mechanism operatively coupled to the drive assembly, the locking mechanism including a coupling mechanism and a locking spindle assembly, the coupling mechanism configured to selectively couple the exterior operator handle to the outer spindle, the locking spindle assembly being rotatably received in the longitudinal bore and configured to operate the coupling mechanism to transition from a locked condition to an unlocked condition by an actuation of the drive assembly; and a lock position sensor located in the interior lockset and communicatively coupled to the control electronics module, the lock position sensor configured to sense whether the coupling mechanism is in the locked condition or the unlocked condition;

wherein a lock status of the lock assembly is one of the locked condition and the unlocked condition; and the lock position sensor further comprising:

a sensor cam having a cam surface, the sensor cam being drivably interposed between the rotatable shaft of the drive assembly and the locking spindle assembly;

a sensing mechanism including a magnet having a North pole and a South pole, the magnet being separate and spaced apart from, the sensor cam, and being operatively associated with the sensor cam surface, such that the sensing mechanism is configured to change a position of the magnet based on a rotational position of the sensor cam, the rotational position of the sensor cam being indicative of the lock status of the lock assembly; and an Omnipolar Hall Effect Sensor configured to detect a presence or an absence of a magnetic field produced by the magnet, the Omnipolar Hall Effect Sensor configured to provide electrical outputs to the control electronics module that correspond to the lock status of the lock assembly.

2. The lock assembly of claim 1, wherein the Omnipolar Hall Effect Sensor is a low power device configured to wake up from a dormant state at predetermined intervals to check for magnetic field presence.

3. The lock assembly of claim 1, wherein the electrical outputs include a first output that represents the North pole and a second output that represents the South pole.

4. The lock assembly of claim 1, wherein the Omnipolar Hall Effect Sensor is located at a null position, and the sensing mechanism is configured to movably position the magnet between a first position and a second position, wherein the null position is located between the first position and the second position, and wherein the first position corresponds to the locked condition and the second position corresponds to the unlocked condition.

5. The lock assembly of claim 4, wherein the sensing mechanism includes:

a magnet holder having a cantilever arm arrangement configured to mount the magnet, the magnet holder being rotatably mounted to a chassis of the interior lockset; and a lift member configured to be vertically displaced by rotation of the sensor cam, the lift member having a cantilever sensor arm having a distal end configured to engage the cantilever arm arrangement of the magnet holder to rotate the magnet holder based on a vertical displacement of the lift member to move the magnet between the first position and the second position.

6. The lock assembly of claim 5, the interior lockset including a housing having a bore, and comprising a sensor pin positioned in the bore, the sensor pin being interposed between the cam surface of the sensor cam and the lift member, the sensor pin configured to be displaced in the bore based on the rotational position of the sensor cam.

7. The lock assembly of claim 1, comprising a clutch assembly interposed between the rotatable shaft of the motor and the locking spindle assembly, the sensor cam being a part of the clutch assembly.

8. The lock assembly of claim 1, wherein the control electronics module is configured to provide at least one of the lock status of the lock assembly to an external device and an internal fault condition detection to the lock assembly.

9. A lock assembly for a door, comprising:

an exterior lockset including an exterior operator assembly having an exterior operator handle;

an interior lockset including an interior operator assembly having an interior operator handle, the interior lockset having a control electronics module;

a latch assembly having a bolt actuator mechanism and a bolt;

an outer spindle operatively coupled to the latch assembly, drivably coupled to the interior operator assembly, and the outer spindle having a longitudinal bore;

a drive assembly having a rotatable shaft;

a locking mechanism operatively coupled to the drive assembly, the locking mechanism including a coupling mechanism and a locking spindle assembly, the coupling mechanism configured to selectively couple the exterior operator handle to the outer spindle, the locking spindle assembly being rotatably received in the longitudinal bore and configured to operate the coupling mechanism to transition from a locked condition to an unlocked condition by an actuation of the drive assembly; and a lock position sensor located in the interior lockset and communicatively coupled to the control electronics module, the lock position sensor configured to sense whether the coupling mechanism is in the locked condition or the unlocked condition; wherein:

the coupling mechanism includes a slide member having a coupling tab and a cam opening, the coupling tab configured to selectively engage a coupling portion of the exterior operator assembly in the unlocked condition and disengage from the coupling portion of the exterior operator assembly in the locked condition; and the locking spindle assembly includes a cam protrusion that is configured to be received in the cam opening of the slide member of the coupling mechanism, the cam protrusion configured to displace the slide member based on a rotational position of the cam protrusion.

10. A lock assembly for a door, comprising:

a latch assembly having a bolt actuator mechanism and a bolt;

an outer spindle operatively coupled to the bolt actuator mechanism of the latch assembly, the outer spindle having a first end and a second end, the outer spindle having a longitudinal bore and configured for rotation about a first axis;

an exterior lockset including an exterior operator assembly and a credential reader, the exterior operator assembly having an exterior operator handle;

a locking mechanism including a coupling mechanism and a locking spindle assembly, the coupling mechanism drivably coupled to the second end of the outer spindle and configured to selectively couple the exterior operator handle to the outer spindle, the locking spindle assembly rotatably received in the longitudinal bore of the outer spindle for rotation about the first axis, the locking spindle assembly including a locking spindle tail member that extends from the first end of the outer spindle, and a locking actuator spindle that extends from the second end of the outer spindle, the locking actuator spindle configured to selectively operate the coupling mechanism to drivably couple the exterior operator assembly to the outer spindle;

an interior lockset including an interior operator assembly, a control electronics module, and a motor drive assembly, the interior operator assembly including an interior operator handle drivably coupled to the first end of the outer spindle, the control electronics module being electrically coupled to the motor drive assembly and the credential reader, the credential reader configured to selectively actuate the motor drive assembly, the motor drive assembly including a motor having a motor shaft rotatable about the first axis, the motor shaft being drivably coupled to the locking spindle tail member of the locking spindle assembly to operate the coupling mechanism when the motor drive assembly is actuated; and a lock position sensor configured to sense whether a lock status of the locking mechanism is in a locked condition or in an unlocked condition, the lock position sensor including:

a sensor cam having a cam surface, the sensor cam being drivably interposed between the motor shaft of the motor drive assembly and the locking spindle tail member of the locking spindle assembly;

a sensing mechanism including a magnet having a North pole and a South pole, the magnet being separate and spaced from, the sensor cam, and being operatively associated with the sensor cam surface, such that the sensing mechanism is configured to change a position of the magnet based on a rotational position of the sensor cam, the rotational position of the sensor cam being indicative of the lock status of the lock assembly; and an Omnipolar Hall Effect Sensor configured to detect a presence or an absence of a magnetic field produced by the magnet, the Omnipolar Hall Effect Sensor configured to provide electrical outputs to the control electronics module that correspond to the lock status of the lock assembly.

11. The lock assembly of claim 10, wherein the lock position sensor is located in the interior lockset.

12. The lock assembly of claim 10, wherein the Omnipolar Hall Effect Sensor is a low power device configured to wake up from a dormant state at predetermined intervals to check for magnetic field presence.

13. The lock assembly of claim 10, wherein the electrical outputs include a first output that represents the North pole and a second output that represents the South pole.

14. The lock assembly of claim 10, wherein the Omnipolar Hall Effect Sensor is located at a null position, and the sensing mechanism is configured to movably position the magnet between a first position and a second position, wherein the null position is located between the first position and the second position, and wherein the first position corresponds to the locked condition and the second position corresponds to the unlocked condition.

15. The lock assembly of claim 14, wherein the sensing mechanism includes:

a magnet holder having a cantilever arm arrangement configured to mount the magnet, the magnet holder being rotatably mounted to a chassis of the interior lockset; and a lift member configured to be vertically displaced by rotation of the sensor cam, the lift member having a cantilever sensor arm having a distal end configured to engage the cantilever arm arrangement of the magnet holder to rotate the magnet holder based on a vertical displacement of the lift member to move the magnet between the first position and the second position.

16. The lock assembly of claim 15, the interior lockset including a housing having a bore perpendicular to the first axis, and comprising a sensor pin positioned in the bore, the sensor pin being interposed between the cam surface of the sensor cam and the lift member, the sensor pin configured to be radially displaced in the bore based on the rotational position of the sensor cam.

17. The lock assembly of claim 15, comprising a clutch assembly interposed between the rotatable shaft of the motor and the locking spindle tail of the locking spindle assembly, the sensor cam being a part of the clutch assembly.

18. The lock assembly of claim 15, wherein the control electronics module is configured to provide at least one of the lock status of the lock assembly to an external device and an internal fault condition detection to the lock assembly.

19. The lock assembly of claim 15, wherein:

the coupling mechanism includes a slide member having a coupling tab and a cam opening, the coupling tab configured to selectively engage a coupling portion of the exterior operator assembly in the unlocked condition and disengage from the coupling portion of the exterior operator assembly in the locked condition; and the locking actuator spindle of the locking spindle assembly includes a cam protrusion that is configured to be received in the cam opening of the slide member of the coupling mechanism, the cam protrusion configured to displace the slide member based on a rotational position of the cam protrusion.

* * * * *